United States Patent [19]

Nakayasu et al.

[11] Patent Number: 4,997,399

[45] Date of Patent: Mar. 5, 1991

[54] EXHAUST SYSTEM FOR SMALL VESSEL

[75] Inventors: Yoshikazu Nakayasu; Ryoichi Nakase; Seiji Inoue, all of Hamamatsu, Japan

[73] Assignee: Sanshin Kogyo Kabushiki Kaisha, Hamamatsu, Japan

[21] Appl. No.: 336,037

[22] Filed: Apr. 11, 1989

[30] Foreign Application Priority Data

Apr. 12, 1988 [JP] Japan ..... 63-88172

[51] Int. Cl.[5] ..... B63B 35/72

[52] U.S. Cl. ..... 440/88; 440/89

[58] Field of Search ..... 440/89, 88; 60/310, 60/320, 321

[56] References Cited

U.S. PATENT DOCUMENTS

| | | | |
|---|---|---|---|
| 3,262,413 | 7/1966 | Douglas et al. . | |
| 3,623,447 | 11/1971 | Jacobson | 440/89 |
| 4,023,353 | 5/1977 | Hall | 440/89 |
| 4,274,357 | 6/1981 | Dawson | 440/89 |
| 4,498,876 | 2/1985 | Zemlicka | 440/89 |
| 4,811,560 | 3/1989 | Nakase et al. | 440/89 |

FOREIGN PATENT DOCUMENTS

| | | | |
|---|---|---|---|
| 306998 | 12/1988 | Japan | 440/89 |

*Primary Examiner*—Sherman Basinger
*Assistant Examiner*—Stephen P. Avila
*Attorney, Agent, or Firm*—Ernest A. Beutler

[57] ABSTRACT

A small watercraft having a number of embodiments of exhaust systems into which coolant from the engine are discharged and which insure that water cannot enter the exhaust ports in the event the watercraft becomes displaced. In all embodiments, a water accumulating volume surrounds the discharge end of the exhaust pipe within an expansion chamber for trapping water in the event the watercraft becomes displaced from its normal condition and for return of the water therefrom upon erection of the watercraft. In a number of embodiments, gravity operated normally open control valves are also provided for closing the end of the exhaust pipe in the event the watercraft becomes displaced from its normal upright condition so as to insure that water cannot enter the exhaust ports of the engine.

12 Claims, 6 Drawing Sheets

EXHAUST SYSTEM FOR SMALL VESSEL

BACKGROUND OF THE INVENTION

This invention relates to an exhaust system for small vessels and more particularly to an improved exhaust system for a small vessel that will insure against the entry of water into the exhaust ports of the engine.

In many instances, a vessel is powered by an internal combustion engine and the exhaust gases from the engine are discharged to the atmosphere through an underwater exhaust gas discharge. When this is the case, there is always a problem that water from the body of water in which the watercraft is operating may enter the engine through the exhaust system. This problem can be encountered even when an above the water exhaust system is employed if the watercraft reaches an unnatural condition, such as being overturned or capsized. Furthermore, it is the normal practice with water cooled internal combustion engines to discharge the cooling water from the engine cooling jacket into the exhaust system at some point before its discharge to the atmosphere. The advantage of discharging the cooling water into the exhaust system is that this serves to cool and silence the exhaust gases. The problem of water entry into the engine with such arrangements is also always prevalent.

Devices have been proposed wherein there is a check valve in the exhaust system that is intended to reduce the likelihood of the water entering the exhaust ports of the engine. However, most of these arrangements employ a check valve that is gravity closed and is opened by the exhaust gas pressure. As a result, this type of valve presents certain back pressure to the engine which can adversely affect performance.

Furthermore, even if a valve is employed in the exhaust system the entry of water into the exhaust system into proximity with the valve can cause the valve to inadvertently open at the wrong time. For example, if the valve is buoyant and the water is such that it tends to open the valve, the water can flow back into the exhaust port.

It is, therefore, a principal object of this invention to provide an improved arrangement for controlling the exhaust gases of a watercraft.

It is a further object of this invention to provide a control valve for the exhaust system of a vessel that will insure that water cannot enter the engine through its exhaust ports and wherein the valve does not create excess back pressure in the system.

It is a further object of this invention to provide a gravity operated exhaust control valve for a watercraft that is normally biased by gravity to an open position and which will close in the event the watercraft assumes an abnormal condition so as to avoid the likelihood of water entering the engine through its exhaust ports.

It is a further object of this invention to provide an improved arrangement for drawing water out of the exhaust system in the event that it enters the exhaust system due to an abnormal condition of the watercraft upon the return of the watercraft to its normal condition.

SUMMARY OF THE INVENTION

A first feature of this invention is adapted to be embodied in an exhaust system for a small watercraft having an internal combustion engine with an exhaust port and an exhaust pipe for conveying exhaust gases from the exhaust port to the atmosphere. In accordance with this feature of the invention, a gravity operated, normally open valve means cooperates with the exhaust pipe for precluding water from flowing to the exhaust port in the event the watercraft is displaced from a normal upright condition.

In accordance with another feature of the invention, an exhaust system for a small watercraft having an internal combustion engine with an exhaust port includes an exhaust pipe for conveying exhaust gases from the exhaust port to the atmosphere. In accordance with this feature of the invention, the exhaust pipe is formed with a well portion that will accumulate water when the watercraft is displaced from a normal condition and from which water will flow by gravity when the watercraft returns to its normal condition so as to preclude this water from re-entering the engine through its exhaust port.

DETAILED DESCRIPTION OF THE PREFERRED EMBODIMENTS

Figure 1:
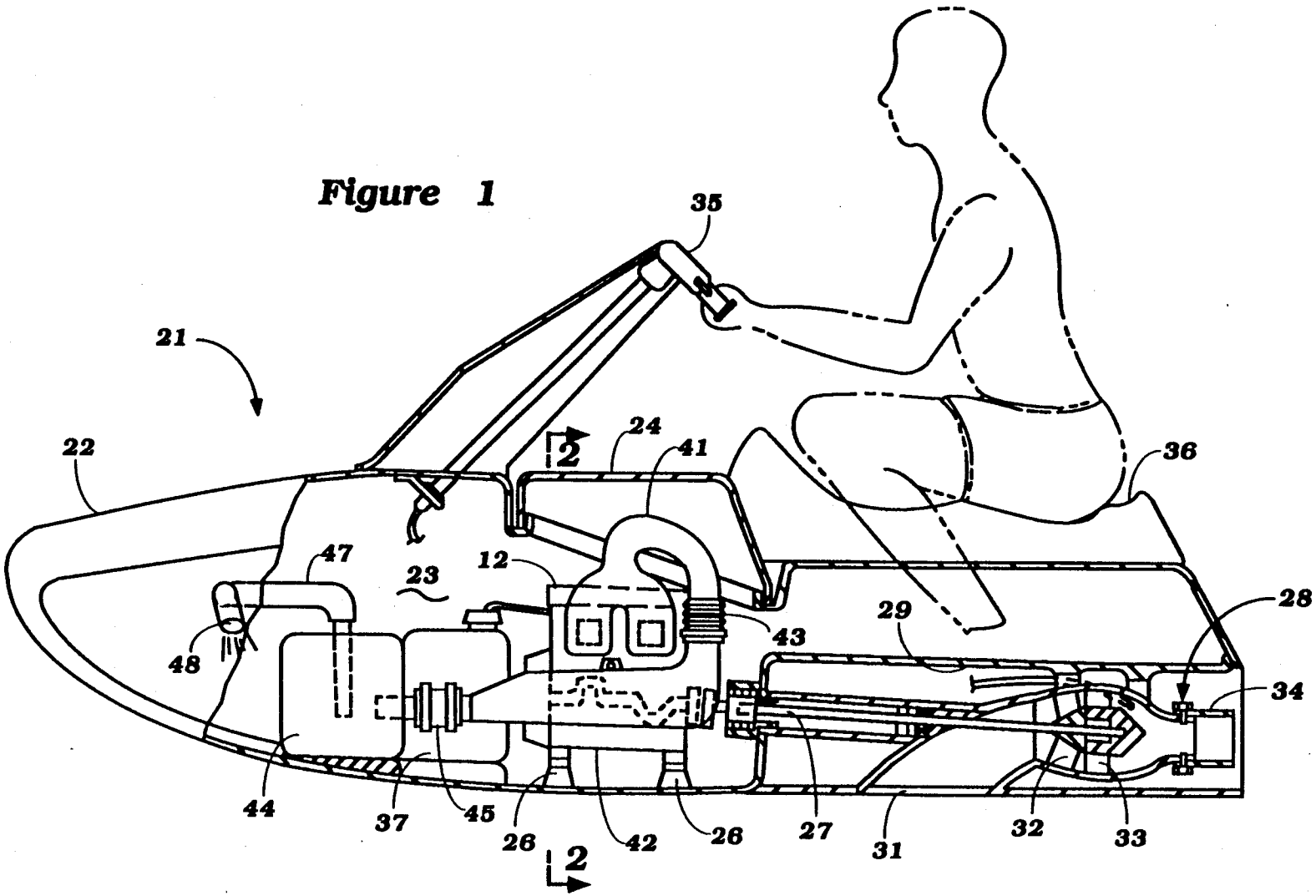
FIG. 1 is a side elevational view of a small watercraft constructed with an embodiment of the invention, with a portion broken away and shown in section.
Figure 2:
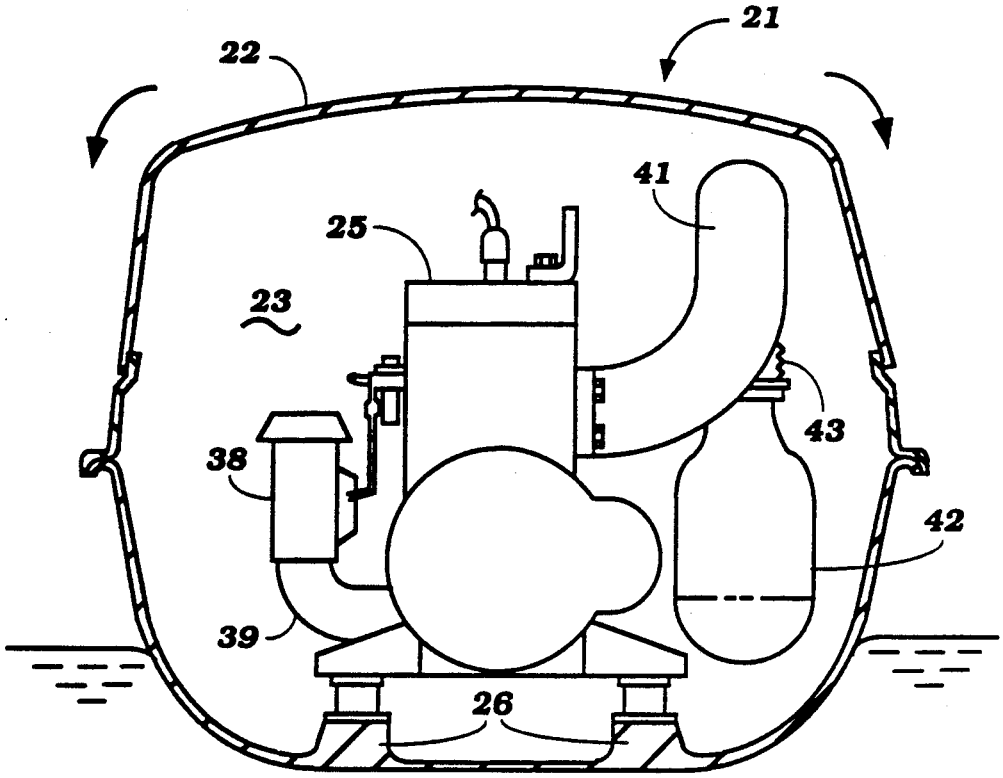
FIG. 2 is a cross-sectional view taken along the line 2—2 of FIG. 1 and is on an enlarged scale.

Referring first in detail to FIGS. 1 and 2, a small watercraft of the type that is designed to utilize the invention is identified generally by the reference numeral 21. The watercraft 21 is of the jet propelled type that is designed to be operated by a single rider seated in straddle fashion and wearing a swimming suit. This is due to the sporting nature of the watercraft 21 and the fact that it is expected that the watercraft may overturn or capsize during its operation due to its sporting nature. Although the invention has particular utility in such a form of watercraft, it is to be understood that the invention may be utilized in conjunction with other types of watercraft.

The watercraft 21 is comprised of a hull 22 that defines a forwardly positioned engine compartment 23 that is closed by means of a removable hatch 24 so as to afford access to an internal combustion engine 25 supported therein. The engine 25 is supported on engine mounts 26 formed at the lower portion of the hull 22 in a known manner. The engine 25 may be of any known type and is depicted as being of the two cylinder, inline, crankcase compression, two-cycle type. It is to be understood, however, that the invention may be practiced in conjunction with engines of other types.

The engine 25 has a crankshaft or output shaft that is coupled to a propeller shaft 27 of a jet propulsion unit, indicated generally by the reference numeral 28, and positioned within a tunnel 29 formed in the underside of the hull 22 rearwardly of the engine compartment 23. The jet propulsion unit 28 includes a downwardly facing water inlet 31 from which water is drawn by an impeller 32 that is contained within the jet propulsion unit 28 for discharge through straightening vanes 33 and a steerable discharge nozzle 34. The discharge nozzle 34 is steered in a known manner by means of a handlebar assembly 35 for changing the direction of the watercraft 21.

A seat 36 is formed above the tunnel 29 and rearwardly of the hatch cover 24 so as to accommodate a single rider in straddle fashion, as aforenoted.

Fuel is supplied to the engine 25 from a fuel tank 37 that is positioned forwardly within the engine compartment 23. This fuel is delivered to one or more carburetors 38 that provide a fuel/air mixture that is delivered to the crankcase of the engine 25 through a manifold 39 in which reed-type check valves (not shown) are contained in a known manner.

The exhaust gases are dischargedfrom the engine 25 through an exhaust manifold 41. The exhaust manifold 41 also receives coolant from the engine cooling jacket, in a manner to be described, and the coolant and exhaust gases are discharged to a generally horizontally extending expansion chamber 42 from the manifold 41 through a flexible conduit 43. The flexible conduit also operates, as will be described, to provide a water reservoir for retaining water in the event the watercraft 21 becomes inverted or capsized and trapping this water for eventual return to the body of water in which the watercraft is operating.

The expansion chamber 42 discharges the exhaust gases and this cooling water to a further expansion chamber 44 through a further flexible conduit 45. These exhaust gases and water vapor are discharged back into the body of water in which the watercraft is operating through a discharge pipe 47 having an outlet 48 disposed in a side of the hull 22.

In accordance with the invention, an arrangement is provided for insuring that any water in the exhaust system, either from the engine cooling jacket or which may enter from the body of water in which the watercraft is operating, cannot pass back into the engine through its exhaust ports. One embodiment of this construction will now be described by particular reference to FIGS. 3 and 4.

As seen in these figures, the exhaust manifold 41 includes an inner jacket portion 49 that receives the exhaust gases and which has a vertically downwardly extending discharge end 51 that terminates in proximity to but above the lower end of the manifold 41. The manifold 41 has an outer wall that defines a jacket 52 around the exhaust manifold portion 49 and which extends further into the coupling 43 than the end 51. Water is introduced from the engine cooling jacket into this water jacket 52 in a known manner.

Figure 3:
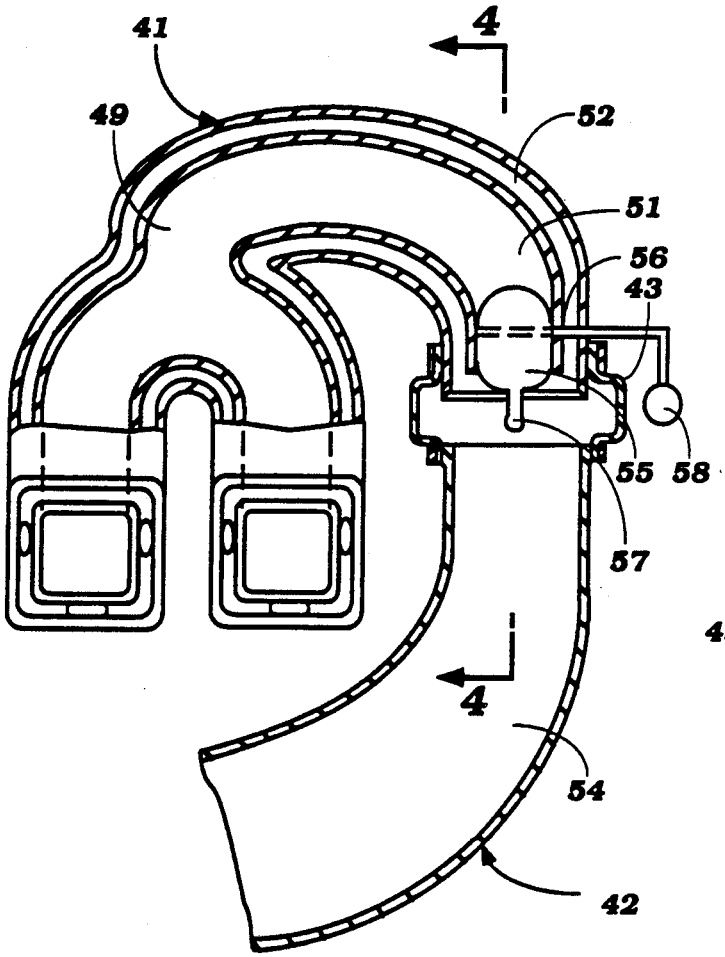
FIG. 3 is a further enlarged side elevational view showing a portion of the exhaust system, with portions broken away and shown in section.
Figure 4:
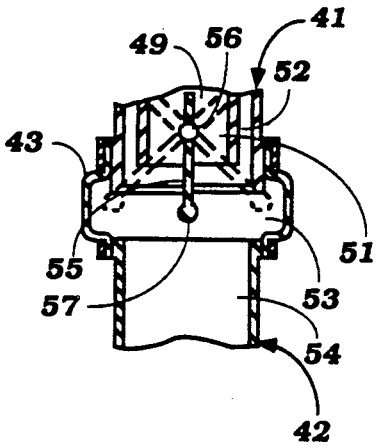
FIG. 4 is a cross-sectional view taken along the line 4—4 of FIG. 3.

As will be noted from FIGS. 3 and 4, the section 43 is formed with an enlarged annular space 53 that extends outwardly beyond the outer periphery of the manifold 41 and specifically its discharge end. In the event the watercraft becomes capsized, water can accumulate in the space 53. However, the space 53 discharges into a vertically extending section 54 of the expansion chamber 42 and has a smooth shape so that when the watercraft is again righted, any water in the space 53 will be discharged immediately into the expansion chamber 42 and cannot be drawn back into the exhaust manifold portion 49.

To further protect against water intrusion, there is provided a gravity operated control valve 55 that is pivotally supported within the exhaust manifold end 51 on a shaft 56 that extends parallel to the longitudinal axis of the watercraft 21. The valve 55 has a lower protruding portion 57 that offers additional weight so as to insure that the valve 55 will be maintained in a normally open position when the watercraft is in its normal erect position. However, in the event the watercraft becomes capsized, which action occurs about a longitudinal axis, the weight of the portion 57 will cause the valve 55 to move to a closed position as shown in the phantom line views in FIG. 4 and to insure that water cannot re-enter the engine through the manifold 41. As soon as the watercraft becomes erect, the valve 55 will again open.

In additional to eccentric mass 57, there may also be provided an external mass 58 that will assist in closure of the valve 55 upon capsizing and opening of it upon righting. The eccentric mass 57 also offers access for manual operation of the valve 55 to check its operation and permit freeing from any carbon deposits which may form and retard valve operation.

Because the valve 55 is positioned upstream from the end of the manifold 41, this will also insure that there is not the likelihood that water will be drawn back into the exhaust manifold portion 49 due to negative pulses that may occur in the exhaust system.

Figure 5:
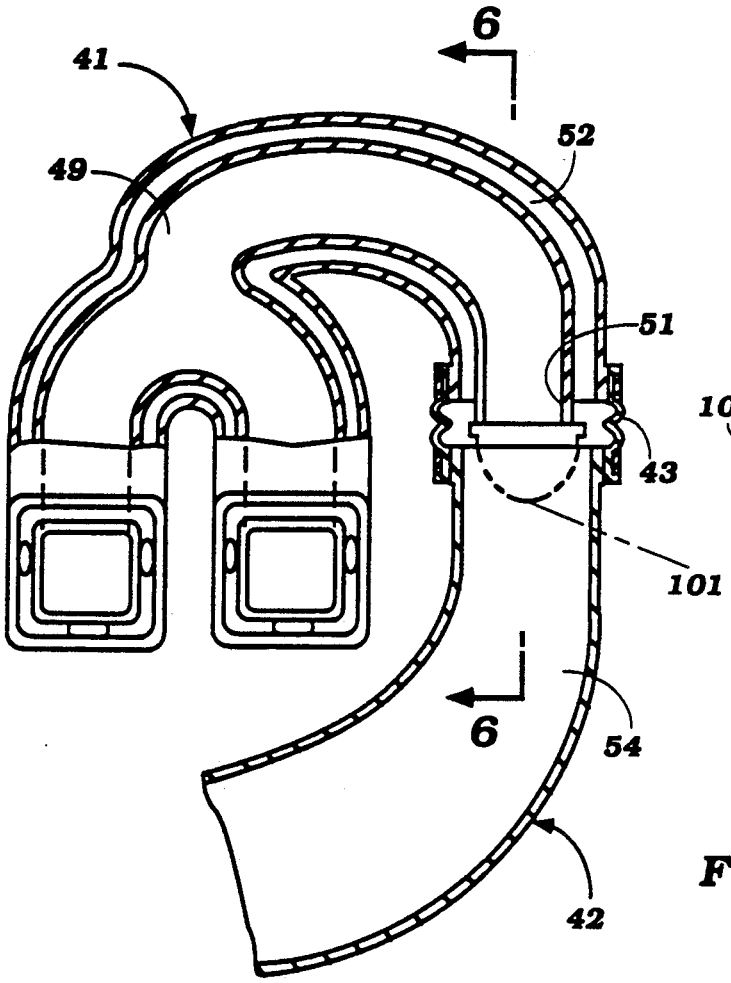
FIG. 5 is a side elevational view, with a portion broken away, in part similar to FIG. 3, showing another embodiment of the invention.
Figure 6:
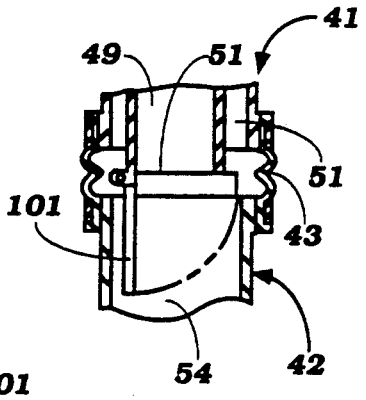
FIG. 6 is a cross-sectional view taken along the line 6—6 of FIG. 5.

FIGS. 5 and 6 depict another embodiment of the invention which is generally similar to the embodiment of FIGS. 3 and 4. In this embodiment, however, a control valve 101 is pivotally supported about a longitudinal axis at one side of the manifold end 51 so that it will not interfere with the flow even in its opened position. In all other regards, this embodiment is the same as the previously described embodiment and, for that reason, components which are the same have been identified by the same reference numeral and will not be described again.

Figure 7:
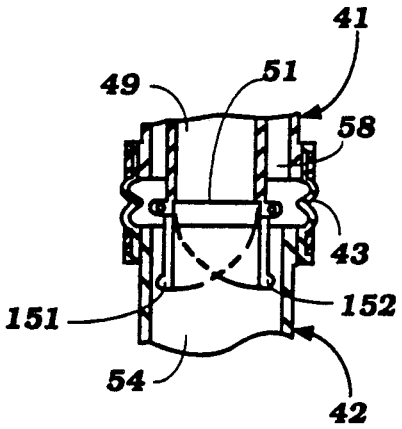
FIG. 7 is a cross-sectional view, in part similar to FIG. 6, showing another embodiment of the invention.

FIG. 7 shows another embodiment of the invention. This embodiment is similar to the embodiment of FIGS. 5 and 6. However, in this embodiment, there are provided a pair of control valves 151 and 152 that are pivotally supported about longitudinal axes at diametrically opposite sides of the exhaust manifold end 51 so as to insure that one of the valves 151 or 152 will be closed regardless of which side the watercraft capsizes onto.

Figure 8:
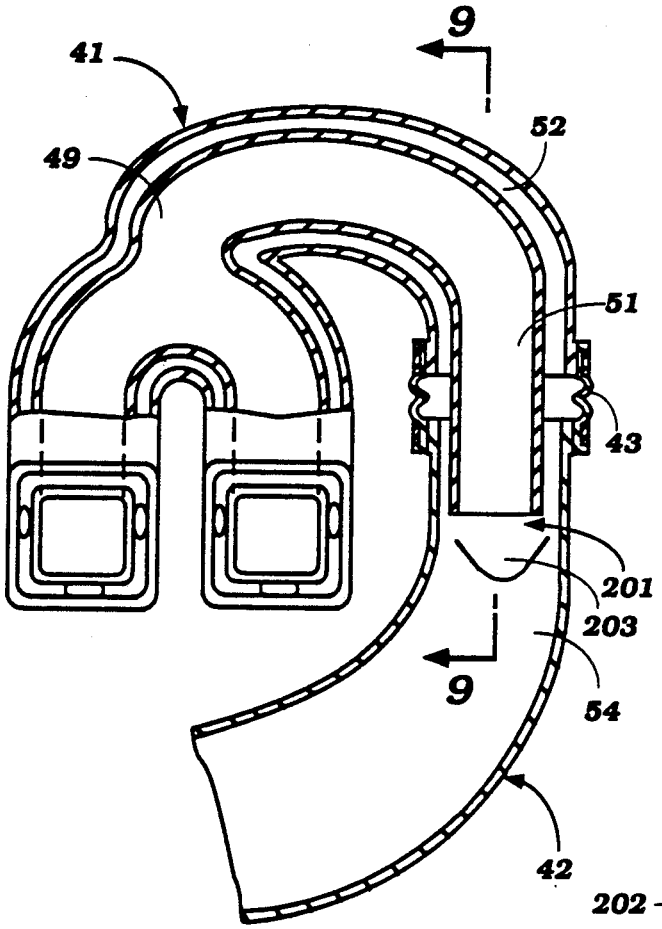
FIG. 8 is a side elevational view, with a portion broken away, in part similar to FIGS. 3 and 5, showing a fourth embodiment of the invention.
Figure 9:
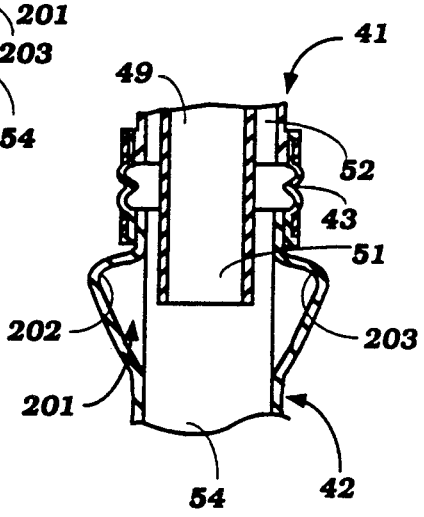
FIG. 9 is a cross-sectional view taken along the line 9—9 of FIG. 8.

FIGS. 8 and 9 show another embodiment of the invention wherein a control valve as employed in the previously described embodiment is not necessary. In this embodiment, the exhaust manifold discharge end 51 is extended into the expansion chamber 42 and the expansion chamber 42 is provided with an enlarged storage area, indicated generally by the reference numeral 201 on opposite longitudinal sides of the expansion chamber so as to receive water when the watercraft is capsized. The section 201 is provided by means of a pair of sections 202 and 203 which have a configuration that generally tapers downward so that water can be trapped therein but will readily flow from them when the watercraft is again righted. In all other regards, this embodiment is the same as those previously described and, for that reason, components which are the same have been identified by the same reference numerals and will not be described again.

Figure 10:
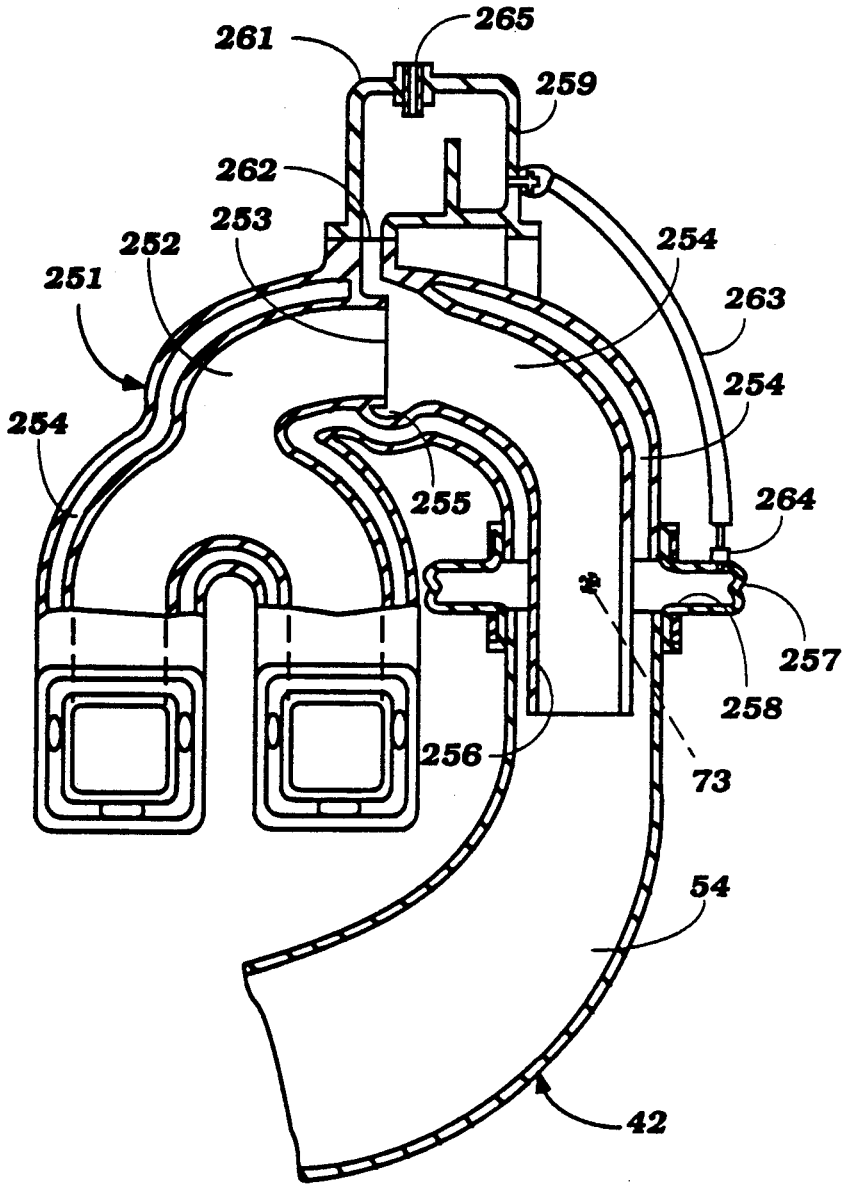
FIG. 10 is a side elevational view, with a portion broken away, in part similar to FIGS. 3, 5, and 8, showing a fifth embodiment of the invention.

FIG. 10 illustrates another embodiment of the invention in which a control valve is not employed. In this embodiment, an exhaust manifold 251 is provided that has an exhaust discharge section 252 that extends horizontally and which terminates at a discharge opening 253. A water jacket 254 encircles the manifold and receives coolant from the engine, as aforedescribed.

The manifold 251 has a further section 254 that is spaced from the section 251 by a small gap around which a water collecting recess 255 is formed. The section 254 has a downwardly extending discharge end 256 that extends vertically and which extends into the expansion chamber 42 and specifically a vertically extending inlet section 54 thereof.

A connector 257 encircles and connects the manifold 251 with the expansion chamber inlet 54 and defines a large water receiving volume 258 into which water may flow when the watercraft is capsized. This water can further flow into a further collecting section 259 formed by a piece 261 that is affixed to the upper side of the manifold 251 and which communicates with the manifold 251 in the area of the water collecting recess 255 through a relatively small passageway 262. A flexible conduit 263 interconnects the chamber 259 with the chamber 258 and there is provided a restrictive nipple 264 at the ends of the conduit 263 so as to permit water to flow from one chamber to the other. A small air vent opening 265 is formed at the top of the chamber 259 so as to facilitate draining of water upon the righting of the watercraft.

It should be readily apparent from the foregoing description that a number of embodiments of the invention have been illustrated and described and each of which is highly effective in insuring that water cannot enter the exhaust system of an engine through its exhaust ports even if the associated watercraft is capsized. Although a number of embodiments of the invention have been illustrated and described, various changes and modifications may be made without departing from the spirit and scope of the invention as defined by the appended claims.

We claim:

1. In an exhaust system for a small watercraft having an internal combustion engine with an exhaust port, an exhaust pipe for conveying exhaust gases from said exhaust port to the atmosphere, the improvement comprising gravity operated normally open valve means cooperating with said exhaust pipe for precluding water from flowing to said exhaust port in the event said watercraft is displaced form a normal, upright condition, said gravity operated valve means being moveable to its closed position when said watercraft is displaced from its normal upright condition to close said exhaust pipe from communication with the atmosphere, and means for delivering engine coolant to said exhaust pipe downstream of said gravity operated valve.

2. In an exhaust system as set forth in claim 1 wherein the gravity operated valve means moves to its closed position when the watercraft is displaced from its normal upright condition to close the exhaust pipe from communication with the atmosphere.

3. In an exhaust system as set forth in claim 2 wherein the gravity operated valve means is a pivotally supported butterfly valve.

4. In an exhaust system as set forth in claim 3 wherein the axis of the butterfly valve passes through a portion of the exhaust pipe.

5. In an exhaust system as set forth in claim 3 wherein the axis of the gravity operated valve is positioned at one side of the exhaust pipe.

6. In an exhaust system as set forth in claim 5 wherein there are two gravity operated valves positioned at diametrically opposite sides of the exhaust pipe.

7. In an exhaust system as set forth in claim 1 wherein the exhaust pipe has a vertically extending section that discharges into an expansion chamber and the valve is positioned at the discharge end of the vertically extending section.

8. In an exhaust system as set forth in claim 7 wherein there is provided a water receiving cavity around the exhaust pipe contiguous to the valve for receiving and trapping water in the event the watercraft becomes capsized, said section communicating with the exhaust chamber through a sloping passageway that extends downwardly when the watercraft is in its upright position for draining water therefrom upon righting of the watercraft.

9. In an exhaust system as set forth in claim 8 wherein the chamber is formed in an extension in the expansion chamber.

10. In an exhaust system for a small watercraft having an internal combustion engine with an exhaust port, an exhaust manifold for conveying exhaust gases from said exhaust port to a discharge and communicating with an exhaust pipe having an inlet and positioned adjacent and spaced from said discharge, and said exhaust pipe communicating at an outlet end with an expansion chamber, the improvement comprising means defining a water storing volume surrounding the discharge end of said exhaust manifold and said inlet end of said exhaust pipe for accumulating water in the even the watercraft becomes displaced from a normal upright condition and for flow of water accumulated therein back to the expansion chamber upon the watercraft being returned to its normal upright condition.

11. In an exhaust system as set forth in claim 10 wherein the discharge end of the exhaust pipe extends vertically and the adjacent portion of the exhaust pipe extends vertically when the watercraft is in its upright condition.

12. In an exhaust system as set forth in claim 11 further including a further water storing volume surrounding said exhaust pipe and adapted to receive water from the first mentioned water storing volume and to drain water back thereto upon erection of the watercraft.

* * * * *